US005086706A

United States Patent [19]

Boivin

[11] Patent Number: 5,086,706

[45] Date of Patent: Feb. 11, 1992

[54] HINGED BOGEY FOR RAIL VEHICLES

[75] Inventor: Gilbert Boivin, Saint Pierre de Varennes, France

[73] Assignee: GEC Alsthom SA, Paris, France

[21] Appl. No.: 552,035

[22] Filed: Jul. 13, 1990

[30] Foreign Application Priority Data

Jul. 18, 1989 [FR] France ..... 89 09619

[51] Int. Cl.[5] ..... B61F 5/02

[52] U.S. Cl. ..... 105/168; 105/199.1; 105/199.2; 105/182.1

[58] Field of Search ..... 105/168, 182.1, 199.1, 105/199.2, 206.1, 206.2, 218.2, 208.2, 179, 184; 384/192, 206

[56] References Cited

U.S. PATENT DOCUMENTS

| | | | |
|---|---|---|---|
| 2,212,989 | 8/1940 | Levy | 105/190 |
| 2,545,956 | 3/1951 | Julien | 105/182 |
| 2,614,507 | 10/1952 | Eksergian | 105/197 |
| 3,313,245 | 4/1967 | Sundby | 105/197 |
| 3,398,700 | 8/1968 | Baker | 105/182 |
| 3,774,549 | 11/1973 | Lich | 105/199.1 X |
| 4,185,854 | 1/1980 | Brando | 105/182.1 X |
| 4,416,492 | 11/1983 | Singletary | 384/192 X |

FOREIGN PATENT DOCUMENTS

| | | |
|---|---|---|
| 1755733 | 3/1973 | Fed. Rep. of Germany . |
| 515140 | 12/1971 | Switzerland . |
| 1203530 | 8/1970 | United Kingdom . |

*Primary Examiner*—Robert J. Oberleitner
*Assistant Examiner*—Kevin D. Rutherford
*Attorney, Agent, or Firm*—Sughrue, Mion, Zinn, Macpeak & Seas

[57] ABSTRACT

A hinged bogey for rail vehicles, the bogey comprising two longitudinal members, two cross-members each fixed to one of the longitudinal members, and a hinge device enabling each longitudinal member to pitch about a central transverse axis. The hinge device comprises a shaft and four bearings, each cross-member including one of the bearings adjacent to the longitudinal member to which it is fixed, and one of the bearings at its opposite end. The bogey is applicable to any rail vehicle.

6 Claims, 6 Drawing Sheets

HINGED BOGEY FOR RAIL VEHICLES

The present invention relates to a hinged bogey for rail vehicles, the bogey comprising two longitudinal members, two cross-members each fixed to one of the longitudinal members, and a hinge device enabling each longitudinal member to pitch about a central transverse axis. Such tilting of each longitudinal member improves the distribution of vertical loads over the four wheels of the bogey, particularly when passing over places including variations in cant inclination or defects in rail leveling.

BACKGROUND OF THE INVENTION

Such a hinged bogey is known, in particular from FIG. 2 of Document FR-2 036 071.

In that bogey, the two cross-members are split on the longitudinal central axis and resiliently interconnected by means of the hinge device which is constituted by two plates including two, four, or eight resilient blocks.

These plates occupy considerable height, as shown in FIG. 3 of said document FR-2 036 071, thereby causing the central position of the bogey to be very voluminous in the vertical direction, and thus making it unsuitable for certain applications, e.g. for applications requiring a floor level which is low over the rails.

In addition, the hinge device is on the longitudinal central axis of the bogey, which complicates installing a motor since motor installation must take place on half a cross-member. Such a bogey is thus mainly a load-carrying bogey.

The object of the present invention is to reduce the vertical extent of the bogey while enabling a motor to be fixed properly on a cross-member, said bogey being equally suitable for use as a driving bogey as a load-carrying bogey.

The solution proposed by the present invention consists in providing each longitudinal member with a cross-member including a portion in the form of a cantilevered beam, in mounting these two cross-members head-to-tail, and in interconnecting them by means of a shaft which allows rotation of the longitudinal members only about the central transverse axis.

SUMMARY OF THE INVENTION

The present invention provides a hinged bogey for rail vehicles, the bogey comprising two longitudinal members, two cross-members each fixed to one of the longitudinal members, and a hinge device enabling each longitudinal member to pitch about a central transverse axis, wherein the hinge device comprises a shaft disposed along the transverse axis which is central to the bogey and four bearings supporting the shaft, with the cross-members being mounted head-to-tail, each end of the shaft being supported by bearings, one of which belongs to one of the cross-members and the other of which belongs to the other cross-member.

One of the two bearings at each end of the shaft is a resilient hinge while the other bearing is a spherical hinge acting as an axial abutment.

A resilient hinge is adjacent to a spherical hinge, thereby limiting the mechanical forces on the parts constituting the hinge device.

The central position of the axis of the hinge shaft makes it possible to install a coaxial anti-roll device. This coaxial disposition cancels the bogey-distorting couple due to the radial reactions of the bearings of the anti-roll device.

In a first embodiment, the shaft is hollow, receiving the anti-roll device which is constituted by a bar having a crank at each end, each crank being connected to the vehicle body by a connecting rod.

In a second embodiment, the anti-roll device is constituted by the shaft itself which is extended beyond the resilient hinges and includes a crank at each end, each crank being connected to the vehicle body by a connecting rod.

BRIEF DESCRIPTION OF THE DRAWINGS

Embodiments of the invention are described by way of example with reference to the accompanying drawings, in which.

DETAILED DESCRIPTION

Figure 1:
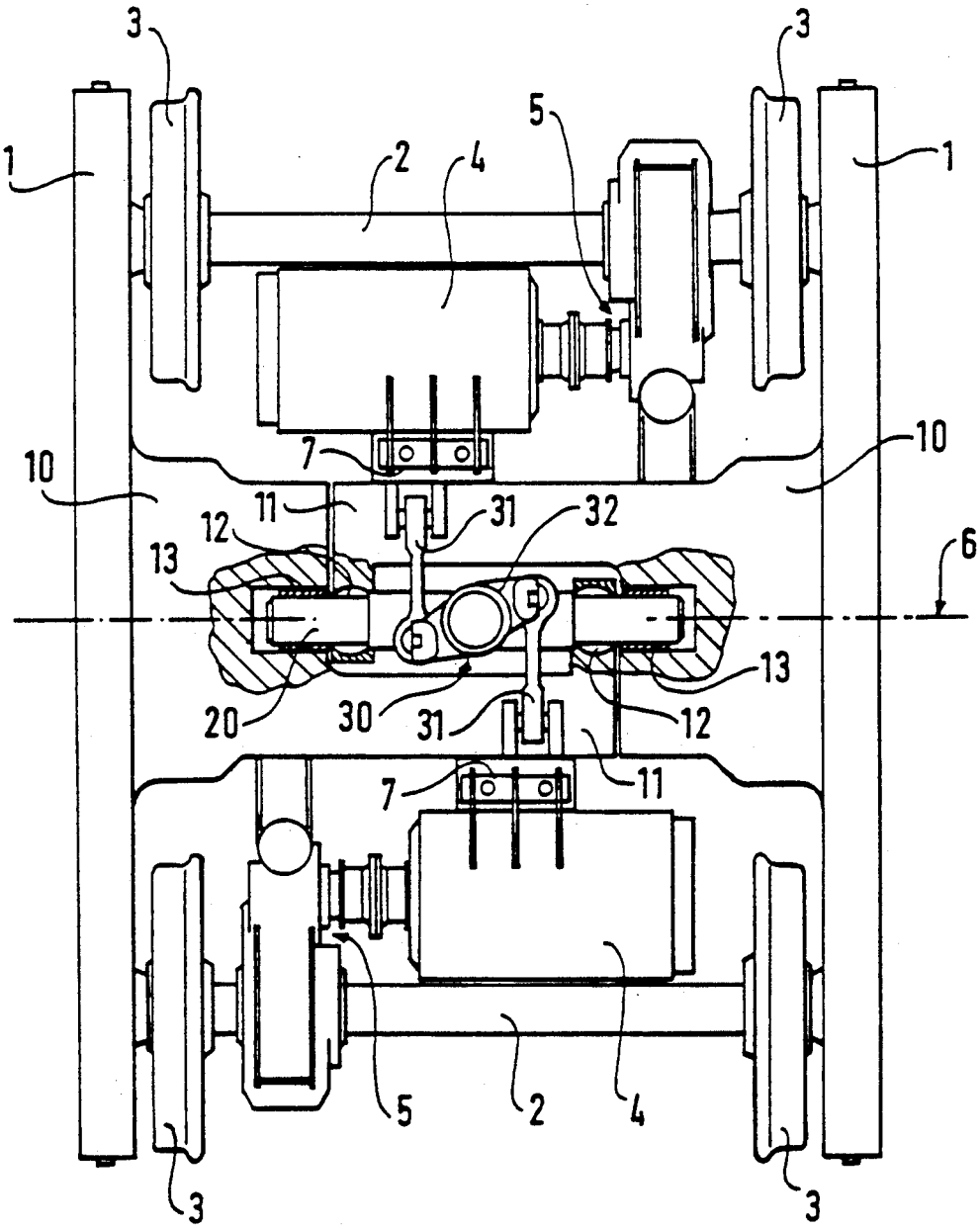
FIG. 1 is a diagrammatic plan view of a bogey without an anti-roll device.

FIG. 1 shows a bogey includng two longitudinal members 1, two axles 2, four wheels 3, and two motors 4 each connected to a corresponding one of the axles via a gear box 5.

The two axles 1 are connected to the longitudinal members 1 via four resilient blocks (not shown) constituting the primary suspension.

Each longitudinal member has a cross-member 10 welded thereto and including a cantilevered beam 11. Each motor 4 is fixed on a beam 11 via a support 7.

The beams 11 of the two cross-members extend beyond the longitudinal central axis of the bogey, and the two cross-members are thus mounted head-to-tail.

The hinge device comprises a shaft 20 and four bearings 12, 13. Each cross-member includes two bearings, one constituted by a spherical knuckle-type hinge 12 and the other by a resilient hinge 13. The shaft 20 interconnects these four hinges, and each longitudinal member is thus capable of tilting about the central transverse axis 6.

The figure shows the minimum spacing that may exist between the two resilient hinges in order to prevent the longitudinal members rolling relative to each other about the longitudinal central axis. The spacing may be maximized by housing each resilient hinge in one of the longitudinal members, and naturally intermediate positions are possible as a function of the room available.

The bogey also includes a drive device 30 constituted by two connecting rods 31 and by a yoke 32, with each connecting rod being hinged at one end to one of the cross-members 10. This drive device serves to apply forces to the bogey which are mainly longitudinal.

Figure 2:
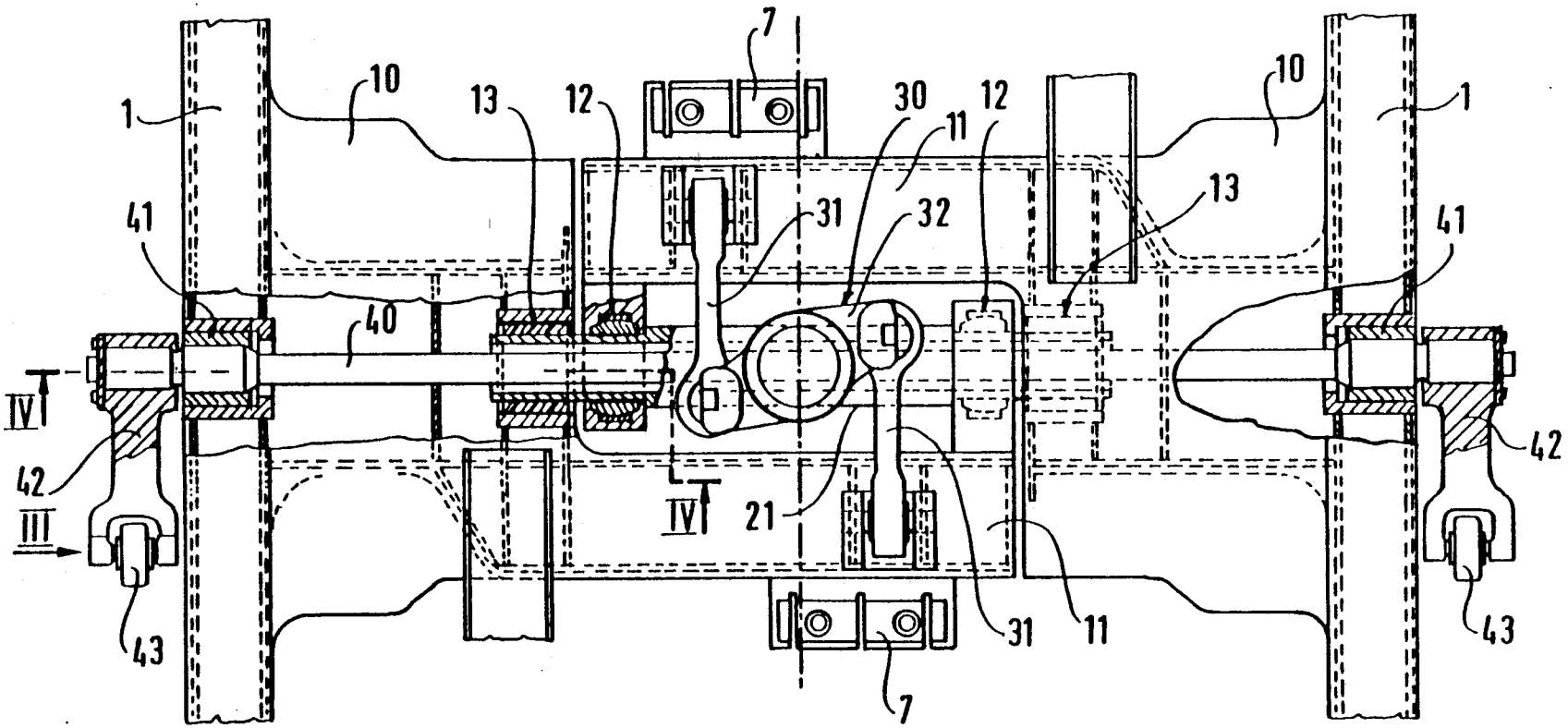
FIG. 2 is a central view of a bogey including a first embodiment of an anti-roll device.
Figure 3:
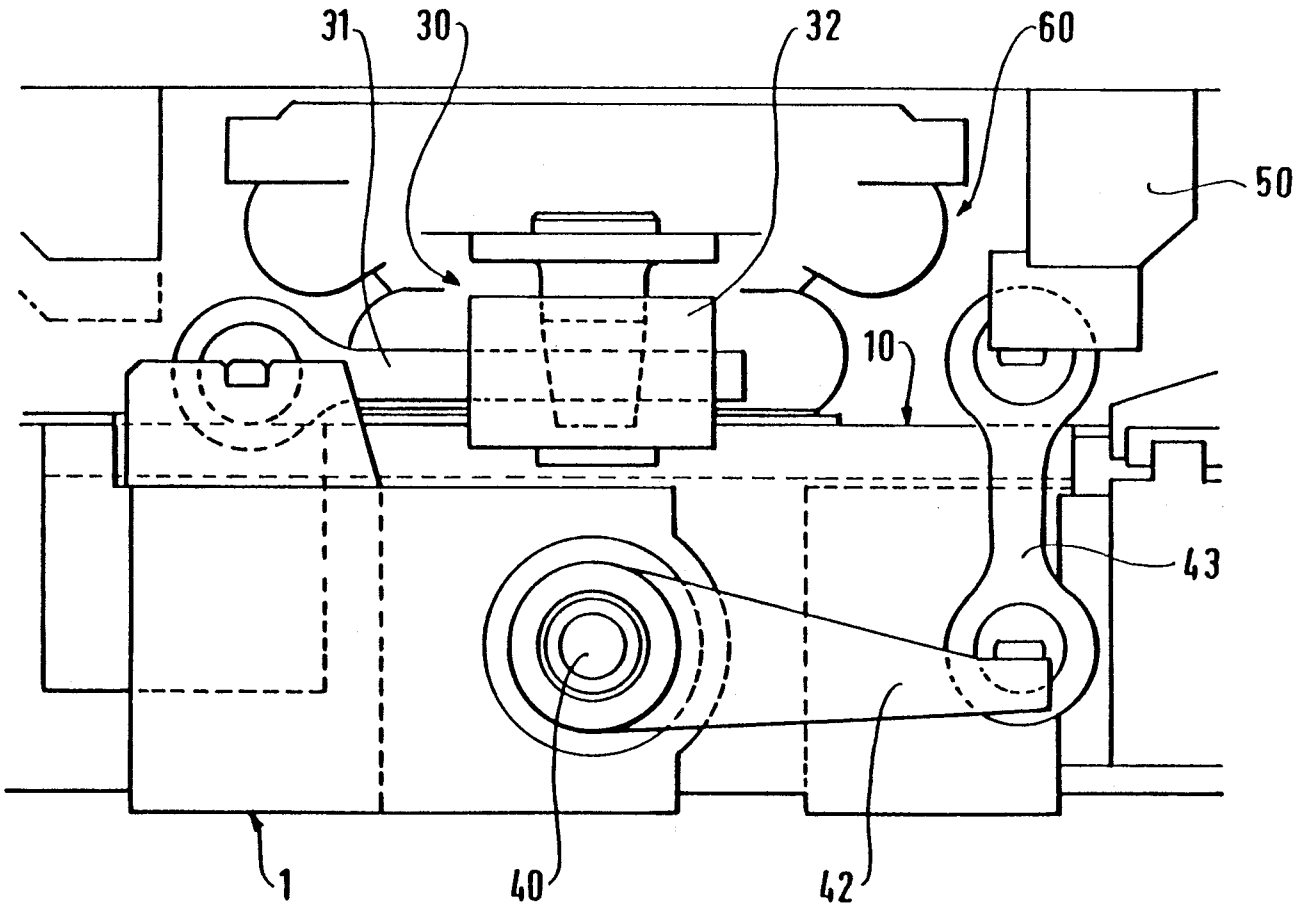
FIG. 3 is a side view of FIG. 2 seen along arrow III.

FIG. 2 shows the same components as FIG. 1, but in this case the shaft 21 is hollow and has an anti-roll bar 40 passing therethrough. This bar pivots in two bearings 41 each situated in a corresponding longitudinal member 1. At each end the bar includes a crank 42 connected to a connecting rod 43. FIG. 3 shows how one of the connecting rods 43 is connected to the corresponding crank 42 and to the body 50 of the vehicle.

It also shows the secondary suspension 60 and the position of the drive device 30 above the cross-members.

Figure 4:
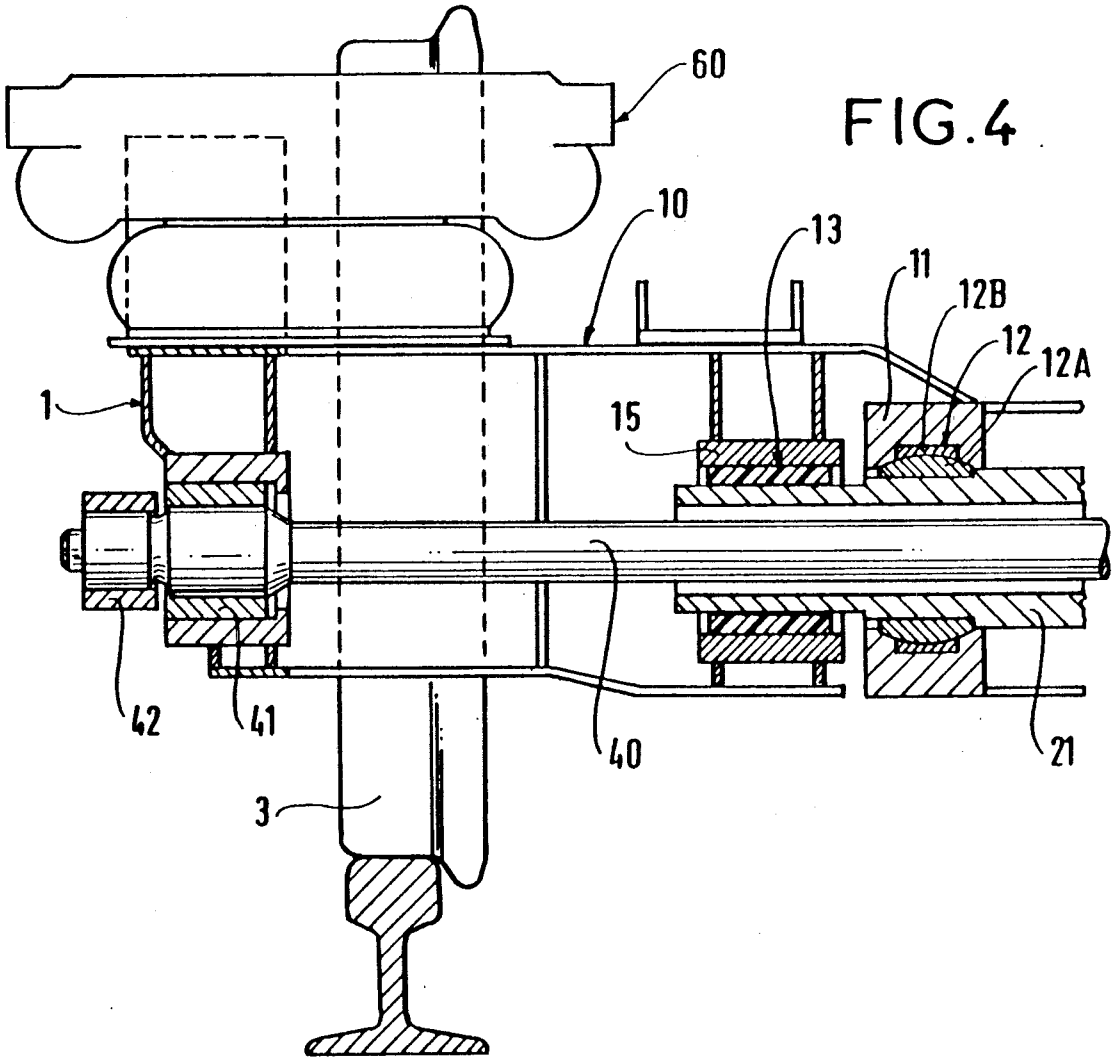
FIG. 4 is a section of FIG. 2 on IV.

FIG. 4 clearly shows the advantage of a resilient hinge 13 in a cage 15 fixed relative to a cross-member 10, said hinge 13 being constituted by a resilient element inserted between two rings (not shown), in association with a spherical hinge 12 in the beam 11 of the other cross-member, with this hinge being constituted by a spherical core 12A and an outer track 12B.

The figure also shows that the longitudinal members and the cross-members are made in the form of welded box girders.

Figure 5:
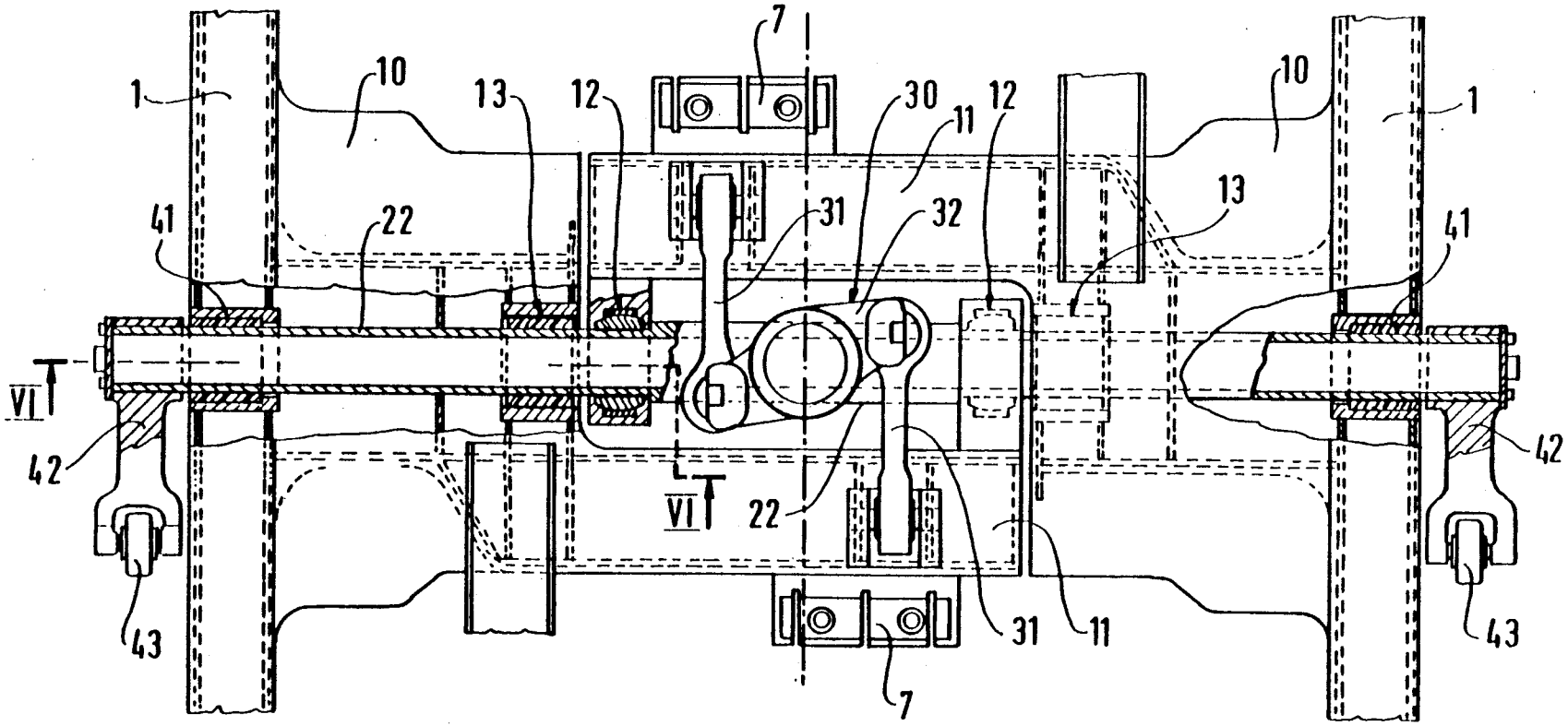
FIG. 5 is a cental veiw of a bogey including a second embodiment of an anti-roll device.

FIG. 5 shows the second embodiment in which the shaft 22 passes through the entire bogey and serves directly as the anti-roll bar. This shaft is hollow, but it could alternatively be solid.

Figure 6:
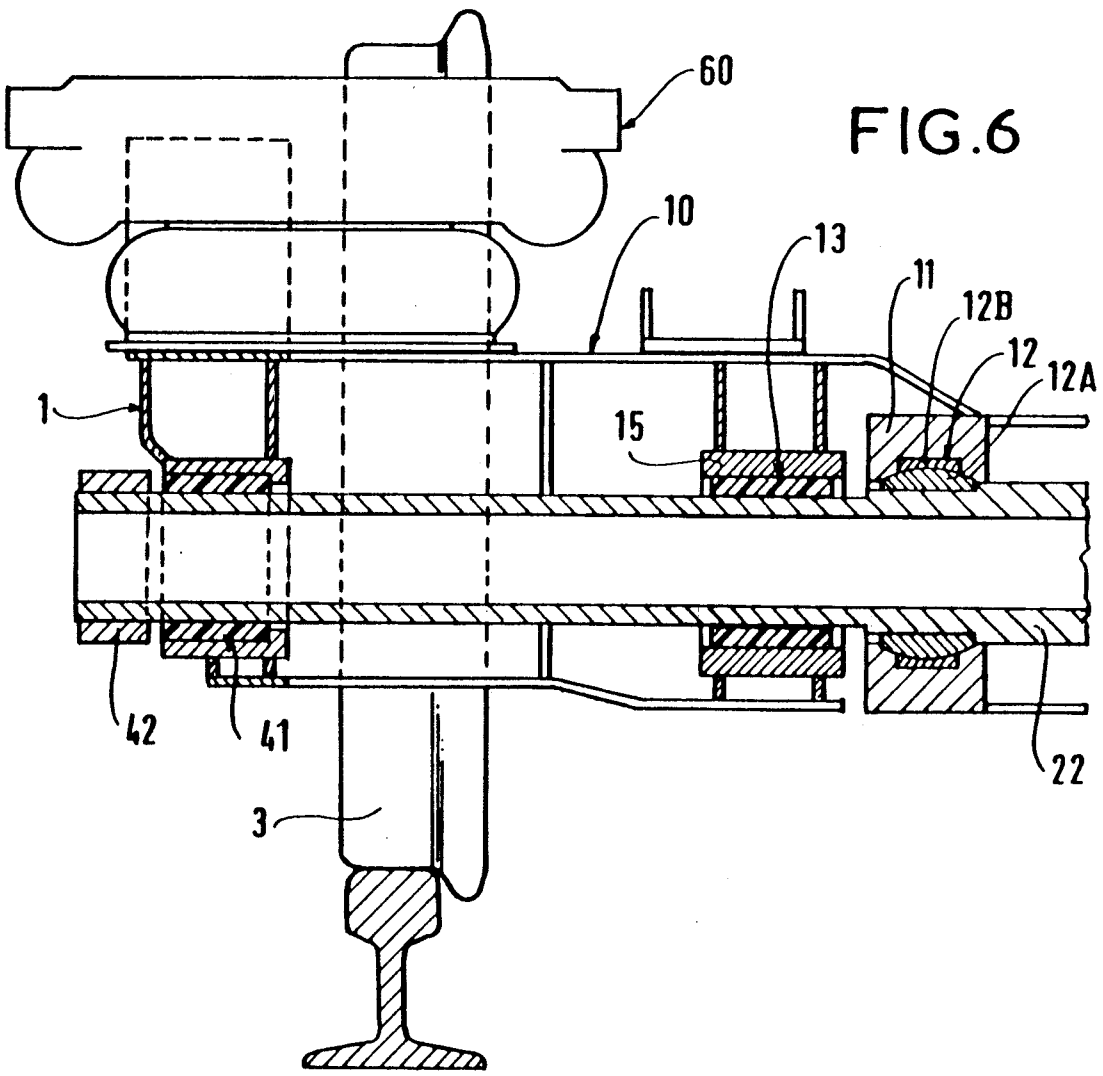
FIG. 6 is a section through FIG. 5 on VI.

FIG. 6 shows how this shaft is mounted between its four hinges 12 and 13 and its two bearings 41 situated in the longitudinal members.

I claim:

1. A hinged bogey for rail vehicles, the bogey comprising two longitudinal members, two cross-members each fixed respectively to one of the longitudinal members, and a hinge device enabling each longitudinal member to pitch about a central transverse axis, wherein the hinge device comprises a shaft disposed along the transverse axis which is central to the bogey and four bearings supporting the shaft, with the cross-members being mounted head-to-tail, each end of the shaft being supported by bearings, one of which belongs to one of the cross-members and the other of which belongs to the other cross member, and wherein one of the two bearings at each end of the of the shaft is a resilient hinge and wherein the other bearing is a spherical hinge acting as an axial abutment.

2. A hinged bogey according to claim 1, wherein said resilient hinge is adjacent to said spherical hinge.

3. A hinged bogey according to claim 2, wherein the shaft is hollow and receives an anti-roll device constituted by a bar having a crank at each end, and each crank being connected to the vehicle body by a connecting rod.

4. A hinged bogey according to claim 2, wherein the shaft is extended beyond the resilient hinges and includes a crank at each end, and each crank being connected to the vehicle body by a connecting rod.

5. A hinged bogey according to claim 1, wherein the shaft is hollow and receives an anti-roll device constituted by a bar having a crank at each end, and each crank being connected to the vehicle body by a connecting rod.

6. A hinged bogey according to claim 1, wherein the shaft is extended beyond the resilient hinges and includes a crank at each end, and each crank being connected to the vehicle body by a connecting rod.

* * * * *